US007174028B1

(12) United States Patent
Niccolai

(10) Patent No.: US 7,174,028 B1
(45) Date of Patent: Feb. 6, 2007

(54) METHOD FOR MANUFACTURING HEARING AIDS, AND A HEARING AID

(75) Inventor: Richard Niccolai, Uster (CH)

(73) Assignee: Phonak AG, Stafa (CH)

( * ) Notice: Subject to any disclaimer, the term of this patent is extended or adjusted under 35 U.S.C. 154(b) by 396 days.

(21) Appl. No.: 09/656,805

(22) Filed: Sep. 7, 2000

(51) Int. Cl.
*H04R 25/00* (2006.01)

(52) U.S. Cl. ..... 381/322; 381/324

(58) Field of Classification Search ..... 381/322, 381/324, 325, 328
See application file for complete search history.

(56) References Cited

U.S. PATENT DOCUMENTS

| | | | | |
|---|---|---|---|---|
| 4,870,689 | A * | 9/1989 | Weiss | 381/325 |
| 5,321,757 | A | 6/1994 | Woodfill, Jr. | |
| 5,530,763 | A * | 6/1996 | Aebi et al. | 381/322 |
| 6,022,311 | A * | 2/2000 | Juneau et al. | 600/25 |
| 6,052,473 | A * | 4/2000 | Clavadetscher et al. | 381/322 |
| 6,493,453 | B1 * | 12/2002 | Glendon | 381/322 |

FOREIGN PATENT DOCUMENTS

| | | | |
|---|---|---|---|
| EP | 0 629 101 A1 | | 12/1994 |
| EP | 0629101 B1 | | 12/1994 |
| EP | 0 821 542 A2 | | 1/1998 |
| EP | 0 821 543 A2 | | 1/1998 |
| JP | 02224599 A | * | 9/1990 |
| WO | 99 56501 A1 | | 11/1999 |

OTHER PUBLICATIONS

Injection Molding Handbook (3rd Edition) edited by Rosato, "Specialized Injection Molding Processes" (15:1216-1224).*

* cited by examiner

*Primary Examiner*—Melur Ramakrishnaiah
*Assistant Examiner*—Phylesha Dabney
(74) *Attorney, Agent, or Firm*—Pearne & Gordon LLP

(57) ABSTRACT

A hearing device is made by manufacturing a first functional part of a first material to provide a first function for the hearing device. A second functional part is manufactured of a second material to provide a second function for the hearing device. The first and second parts are assembled to form a composite part to provide both of the first and second functions at the hearing device. The second functional part is injection molded integrally with the first part while simultaneously performing manufacturing of the second part and assembling of the second part and the first part. The manufacturing and assembling of the first and second part take place within a common mold.

17 Claims, 2 Drawing Sheets

METHOD FOR MANUFACTURING HEARING AIDS, AND A HEARING AID

FIELD OF THE INVENTION

The present invention relates to a method defined in the preamble of claim 1 and to a hearing aid defined in the preamble of claim 9.

BACKGROUND OF THE INVENTION

Two-component or multi-component injection molding procedures are known from the art of plastic processing. Illustratively reference is made to Ch. Jaroschek, "Das Mehrkomponenten-Spritzgiessverfahren' [Multi-component injection molding"] in Swiss Plastics 19 [1997] #12 or to U. Stenglin "Hart/Weich-Verbindungen und anwendungsbezogene Modizifierbarkeit von TPE-S (SEBS/SEPS)" [Hard/soft compounds and application-specific modification of TPE-S (SEBS/SEPS), Swiss Plastic 20 [1998] #3. These sources elucidate the advantages of two- or multi-component injection molding with respect to costs of tools, personnel, machinery and materials. These methods basically are categorized into sandwich molding injection and overmolding procedures. If not exclusively but primarily, the interest herein is the cited overmolding method. In this procedure a part is manufactured from a first material component and it is then overfilled at least segment-wise with a second, different material component, the second part of a different material being built-up on the said first part. All sprayable thermoplastics can be used, in particular also for overmolding, and furthermore, even if in very special applications, also further materials which cannot be joined.

The above cited costs obviously also represent substantive production factors in the manufacture of hearing aids. But with respect to the manufacture of hearing aids, there is additionally the problem of space because a permanent requirement of this field is always the most compact possible design.

BRIEF SUMMARY OF THE INVENTION

The objective of the present invention is a manufacturing method and a hearing aid made thereby to attain a significant increase in the compactness of hearing aids.

Consequently the method proposes manufacturing at least two of the parts to be assembled at the hearing aid by two-component or multi-component injection molding and to assemble them jointly. Obviously the advantage of cost reduction accompanying such a procedure is highly welcome, however more significantly, the method of the present invention attains the essential criterion in hearing-aid design, namely increasing the component density per $cm^3$ of the available space.

When, according to a preferred implementation of the method of the invention, one of the parts shall be at least a portion of the hearing-aid housing, namely and illustratively one shell of a two-shell housing, then it will be possible to appose directly—by means of two-component or multi-component injection molding—further elements, in particular seals for instance to set up a tight union with the second housing shell and/or impact-damping recesses for delicate hearing-aid elements and/or further active hearing-aid elements such as acoustic conductors. Basically this feature makes it possible eliminating junction means between said cited parts and elements that are required in conventional designs, or such means may be made precisely as compact as required functionally without the need for junction means such as grooves and tabs.

As already mentioned, basically the preferred implementation of the method of the invention builds up at least one design seal by means of two- or multi-component injection molding, in general jointly with a further part directly abutting the seal, for instance and preferably a housing part or an operational element passing through the housing or a further hearing-aid part which must be sealed per se very accurately.

In another preferred implementation of the manufacturing method and in particular regarding behind the ear hearing aids, the invention proposes manufacturing the acoustic conductor at the output of the electro-mechanical transducer, said conductor typically being made of plastic, using said injection molding, whether jointly directly with a housing part or for instance with a resiliently and topographically sealing assembly part that shall be received in a housing seat.

In a further preferred embodiment of the method, an acoustic conductor is manufactured at the input of the acousto-electric hearing-aid transductor by means of the injection molding, whether for instance this be jointly with a portion of the hearing aid housing or with a specifically designed elastic assembly part. In further modes implementing the invention, where said modes obviously may be used individually or in combination with other preferred embodiments, seats for hearing aid elements are manufactured by said injection molding, whether jointly with housing portions and/or jointly with other elements directly abutting them.

In another preferred implementation of the invention, predetermined surface zones made of another material are jointly manufactured on the housing outside by means of said injection molding, for instance for reasons of design and/or to facilitate touching, with the fingers alone, certain control elements mounted on the housing.

The invention is elucidated below in illustrative manner and in relation to the drawings.

DETAILED DESCRIPTION OF THE INVENTION

The discussion already given above in the introduction to the specification provide the expert with a large number of designs, depending on the hearing aid or its configuration, to jointly manufacture two or more pertinent elements by two- or multi-component injection molding, in particular also by overmolding and then to assemble them jointly into an integral part. Nevertheless preferred procedures of the cited injection molding method shall be provided below by means of several schematic examples. The actual two-component or multi-component molding procedures will not be discussed because being well known in the general manufacture of components, in particular in plastic molding and injection molding.

Figure 1:
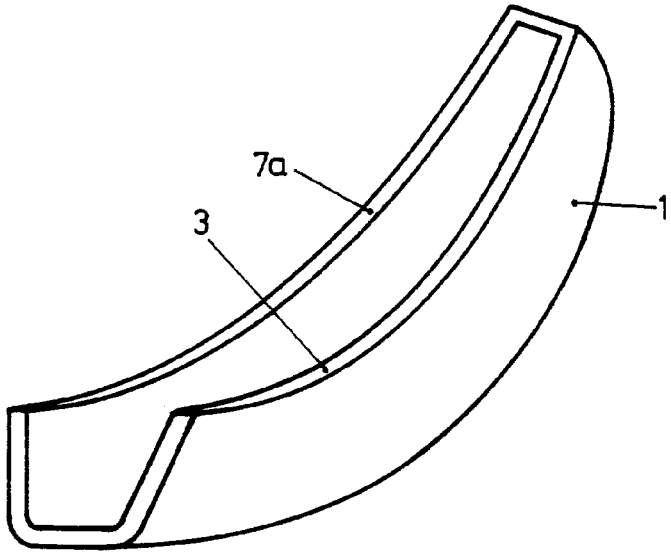
FIG. 1 schematically shows a perspective of a portion of a hearing aid housing with a seal apposed in the manner of the invention.
Figure 3:
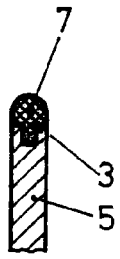
FIG. 3 is a cross-section of the housing wall of a hearing aid of conventional manufacture with assembled seal, FIG. 4 schematically shows a cross-section of a portion of the hearing-aid housing with an acoustic conductor apposed in the manner of the invention and/or with a seat for a module, FIG. 5 schematically shows a cross-section of a housing wall portion with control element and with a feedthrough of the invention and a unit support, and FIG. 6 schematically and in functional manner shows the connection of the invention of two hearing-aid functional units.

FIG. 1 schematically and in perspective shows the shell 1 of a hearing aid housing, for instance of behind-the-ear hearing aid. This shell will be assembled along its edges 3 to further housing portions in such manner that its inside space shall be tightly sealed along these edges 3. This problem is conventionally solved in that—as shown in FIG. 3—positioning and fastening means are integrated in this shell as shown, for instance grooves in the wall of the housing part 1 into which, and again manually, is inserted a seal 7.

As regards the invention, a seal 7*a* is sprayed by two-component injection overmolding directly on the cited housing shell 1, ie the edge 3. In this implementation the material of the housing wall per se meets the dimensional-stability requirements placed on the housing, while the material of the second part sprayed by overmolding meets the requirements placed on the seal 7*a*. In this process the seal 7*a* can be sized exactly as needed by sealing and the wall of the housing part 1 also may be dimensioned and shaped exclusively in the light of criteria set on the wall of the housing part 1. The housing wall no longer need to be designed to meet the requirements of assembling a separate seal 7 of FIG. 3.

Figure 4:
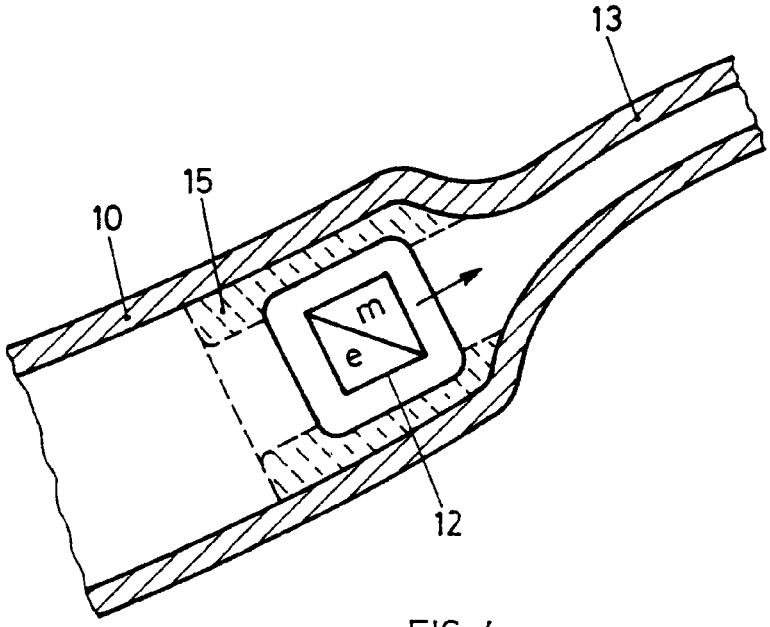

FIG. 4 schematically shows illustratively how, on one hand regarding a hearing aid housing 10, the invention apposes an acoustical conductor 13, for instance at the output of an electromechanical transducer mounting in the hearing aid, or similarly, at the input of an acoustic/electrical transducer (omitted) present at the hearing aid. In addition a resilient bush 15 seating the transducer 12 may be integrated into the housing 10. The housing 10 and the acoustic conductor 13 and/or the housing 10 and the seating bush 15, or all three, namely the housing 10, seating bush 15 and acoustic conductor 13 are manufactured as one part by two- or three-component injection molding. The material of the housing 10 or of its wall is selected in a conventional manner to meet the requirements set on said housing, and as regards the material of the acoustic conductor 13 is selected for instance to be bio-compatible with the behind-the-ear hearing aid, and as regards the material for the seating bush 15, it will be one that meets the requirements of impact damping and holding in place the transducer 12 under such conditions. The material of the bush 15 may be readily selected to be electrically conducting if for instance the transducer 12 should be electrically screened.

Figure 5:
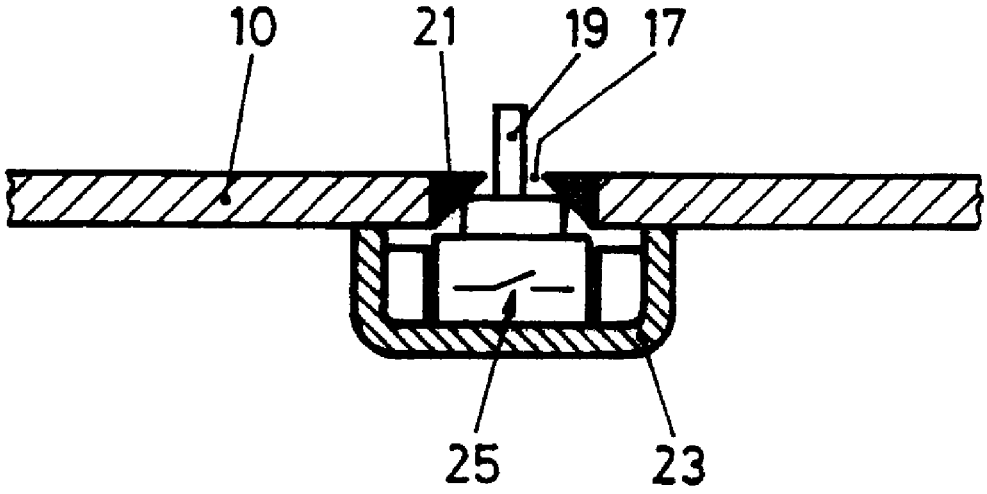

FIG. 5 again shown in schematic manner a first part, again illustratively a wall of a housing part 10 comprising a feedthrough aperture 17 passing a control element 19 such as a switch which passes through an operating means 25 of the hearing aid. Because resilient and optionally sealing parts 21 are sprayed jointly with the housing 10 by two- or multi-component injection molding in the rim zone of the feedthrough 17 for the control element 19 and because where called for additionally also a seat 23 to resiliently affix the unit 25 in flush manner, the unit 25 can be integrated in optimally compact manner.

Figure 6:
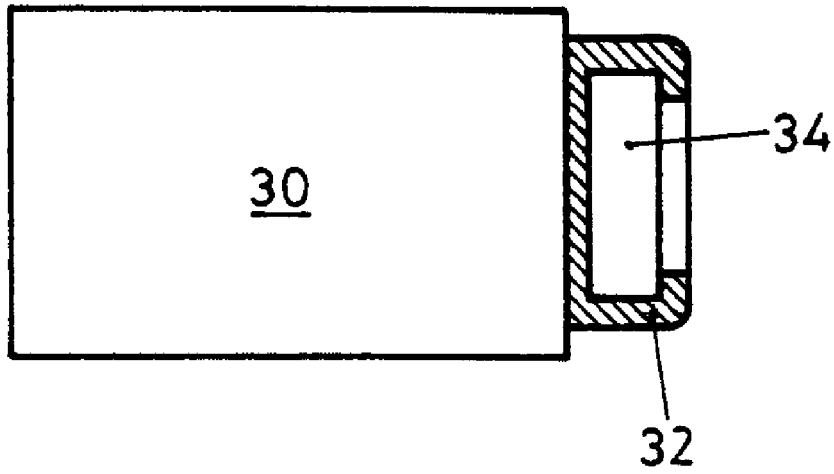

FIG. 6 shows how a seat 32 to appropriately position and hold a further system 34, for instance a hearing-aid electronic module, can be apposed—using the said two- or multi-component injection molding—at the housing 30 so a system 34 such as a hearing aid electronic module, as a result of which optimally compact assembly of high packing density is again attained.

Figure 2:
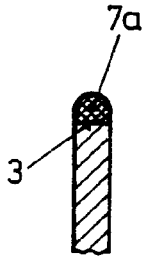
FIG. 2 is a cross-section of a part of the housing of FIG. 1 with the apposed seal of the invention.

Large savings are realized in the manufacturing method of the invention: Assembly steps are eliminated by integral two- or multi-component manufacture. Moreover an advantage particularly applying to hearing aids is achieved that functionally different elements which following assembly anyway come to be abutting each other can be fitted in controlled manner with the particular needed material properties. In this manner volume-wasting steps for retrofitting such parts are eliminated. As shown for instance by the embodiment of FIGS. 1 through 3, it is clear that a seal 7*a* which need meeting only the sealing requirements can be made much smaller and thinner if integrated into the part 1 than if manufactured separately as a seal 7 and subsequently requiring mounting—for instance manually—to the corresponding edges of the part 1, whether by bonding, insertion or the like. When assembling separate elements, the accuracy with which the sealing element 7*a* can be apposed to the edge 3 constituted by the wall of the part 1 is hardly possible, given the same dimensions, or if so, only at high cost.

The invention claimed is:

1. A method of manufacturing a hearing device comprising:

manufacturing a first functional part of a first material to provide a first function for the hearing device;

manufacturing a second functional part of a second material to provide a second function for the hearing device;

assembling said first and second functional parts to form a composite part to provide both said first and second functions at the hearing device, thereby injection molding said second functional part of said second material integrally with said first part and simultaneously performing manufacturing of said second part of said second material and assembling of said second part and of said first part of said first material, and wherein manufacturing and assembling the first and second functional parts take place within a common mold.

2. The method of claim 1, wherein at least one of the first and second functional parts is a portion of a housing of the hearing device.

3. The method of claim 1, wherein at least one of the first and second functional parts is a seal.

4. The method of claim 1, wherein one of the first and second functional parts is a portion of a housing of the hearing device and the other of the first and second functional parts is a seal.

5. The method of claim 1, wherein at least one of the first and second functional parts is an acoustical conductor.

6. The method of claim 5, wherein the acoustical conductor is formed at an output side of an electromechanical transducer of the hearing device.

7. The method of claim 5, wherein the acoustical conductor is formed at an input side of an acoustical/electrical transducer of the hearing device.

8. The method of claim 1, wherein one of the first and second functional parts is a resilient bush configured to seat a transducer.

9. The method of claim 1 further comprising, forming and joining a third functional part of the hearing device integrally with the first and second functional parts by multi component injection molding.

10. The method of claim 9, wherein the first, second, and third functional parts comprise a housing, a seating bush, and an acoustical conductor.

11. The method of claim 1, wherein said second functional part is a rim portion of a feed-through aperture of a housing.

12. The method of claim 1, wherein the first functional part is a first surface area of a housing for the hearing device and the second functional part is a second surface area of the housing, the second surface area being adjacent to the first surface area.

13. The method of claim 12, wherein the first and second surface areas are differently palpable.

14. The method of claim 1, further comprising mounting a unit of the hearing device into an opening of a bordering area, the bordering area being formed by the first and second functional parts.

15. The method of claim 14 wherein the unit of the hearing device is a manually operable control element.

16. The method of claim 1, wherein said first functional part is injection molded of said first material simultaneously with injection molding said second functional part of said second material.

17. A method of manufacturing a hearing device comprising:

manufacturing a first functional part of a first material to provide a first function for the hearing device and as a first separate part;

manufacturing a second functional part of a second material to provide a second function for the hearing device and as a second part; and assembly the first and second separate parts to form a composite part to provide both the first and the second function at the hearing device;

wherein injection molding the second functional part of the second material integrally with the first part and thereby simultaneously performing manufacturing of the second part of the second material and assembling the second part and the first part of the first material.

* * * * *